US005666728A

United States Patent [19]

Silva

[11] Patent Number: 5,666,728

[45] Date of Patent: Sep. 16, 1997

[54] CUTICLE TRIMMER

[76] Inventor: Jose Belchior Silva, 55 Daniel St., Port Reading, N.J. 07064

[21] Appl. No.: 387,328

[22] Filed: Feb. 13, 1995

[51] Int. Cl.[6] ..... A45D 29/02

[52] U.S. Cl. ..... 30/28; 30/176; 132/75.5; 132/75.6

[58] Field of Search ..... 30/28, 142, 145, 30/175, 176, 146; 7/162; 132/73, 73.5, 75, 75.3, 75.4, 75.5, 75.6, 76.2

[56] References Cited

U.S. PATENT DOCUMENTS

| | | | |
|---|---|---|---|
| Re. 26,344 | 2/1968 | Reswick | 132/75.5 X |
| 767,423 | 8/1904 | Nicholls | 30/28 X |
| 1,828,121 | 10/1931 | Adam et al. | 30/146 X |
| 1,841,847 | 1/1932 | Peters | 30/28 |
| 2,999,505 | 9/1961 | Herstedt | 132/73.5 |
| 3,261,094 | 7/1966 | Bliss | 132/75.6 X |
| 3,315,354 | 4/1967 | Oates, Jr. | 30/28 |
| 3,316,634 | 5/1967 | Bliss | 30/28 X |
| 4,731,927 | 3/1988 | Wilson | 30/28 |

*Primary Examiner*—Eugenia Jones

[57] ABSTRACT

A cuticle trimmer having a first cutter assembly, wherein pivotally mounted within the first and second cutter plates of the first cutter assembly is a second cutter assembly. The first cutter assembly terminates in concave blade edges for cooperation relative to one another, with the second cutter assembly having cooperative convex blade edges to accommodate various cuticle cutting conditions. A file plate is further employed mounted between the third and fourth cutter plates of the second cutter assembly.

3 Claims, 2 Drawing Sheets

CUTICLE TRIMMER

TECHNICAL FIELD

The field of invention relates to cuticle cutter structure, and more particularly to a cuticle trimmer wherein the same employs cooperatively mounted cutter assemblies, with the first cutter assembly terminating in concave cutting edges and the second cutter assembly terminating in convex cutting edges.

BACKGROUND OF THE INVENTION

Various cuticle cutter structure is available in the prior art for the use of cuticle trimming such as exemplified in U.S. Pat. No. 4,940,136.

The present invention attempts to overcome deficiencies of the prior art by directing the use of a plurality of cutter assemblies mounted together for cooperation, such that convex and concave cutting edges are available relative to the respective first and second cutter assemblies permitting the cutting of cuticles at various orientations about an individual's toes, such that prior art structure typically employs only a single-type cuticle cutter assembly limiting flexibility in the cutting of variously shaped cuticles relative to the fingers and toes of an individual.

SUMMARY OF THE INVENTION

The cuticle trimmer having a first cutter assembly, wherein pivotally mounted within the first and second cutter plates of the first cutter assembly is a second cutter assembly. The first cutter assembly terminates in concave blade edges for cooperation relative to one another, with the second cutter assembly having cooperative convex blade edges to accommodate various cuticle cutting conditions. A file plate is further employed mounted between the third and fourth cutter plates of the second cutter assembly.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
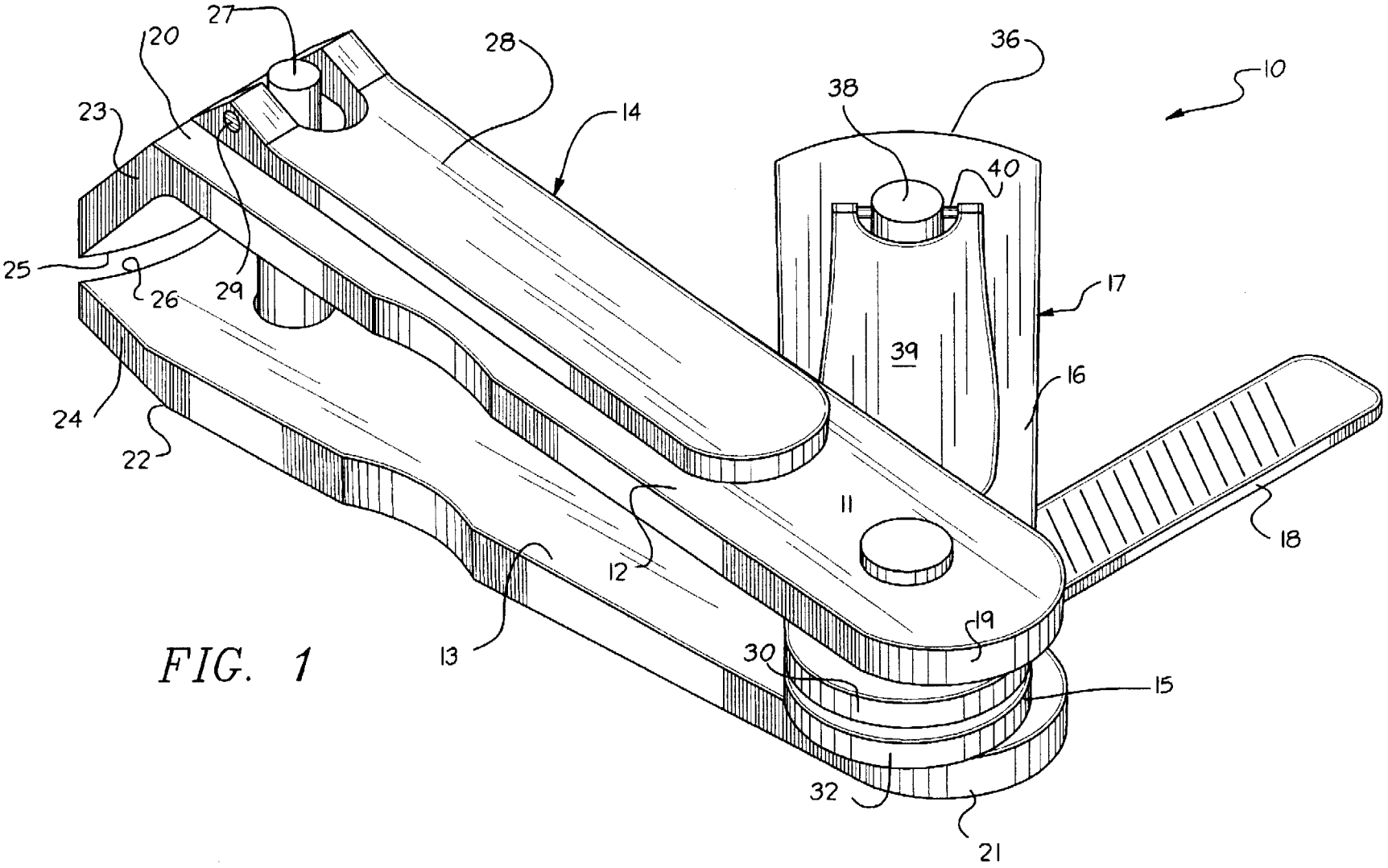
FIG. 1 is an isometric illustration of the invention.
Figure 2:
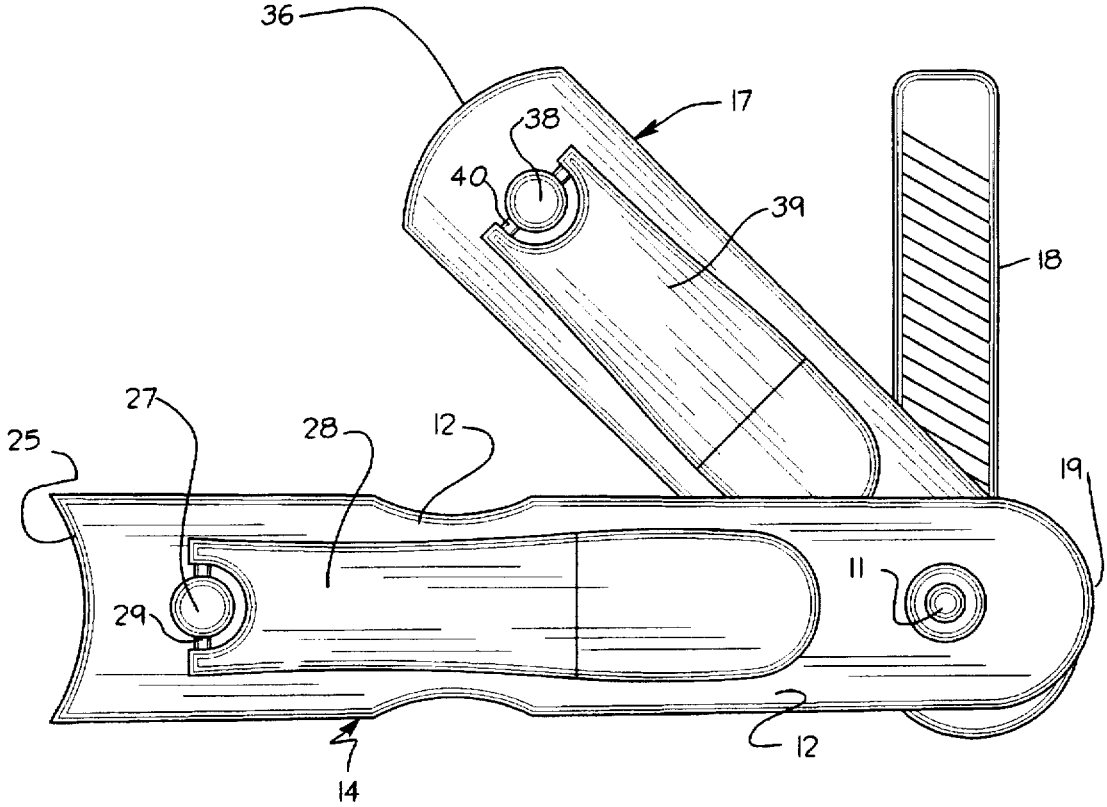
FIG. 2 is a top plan view of the invention.
Figure 3:
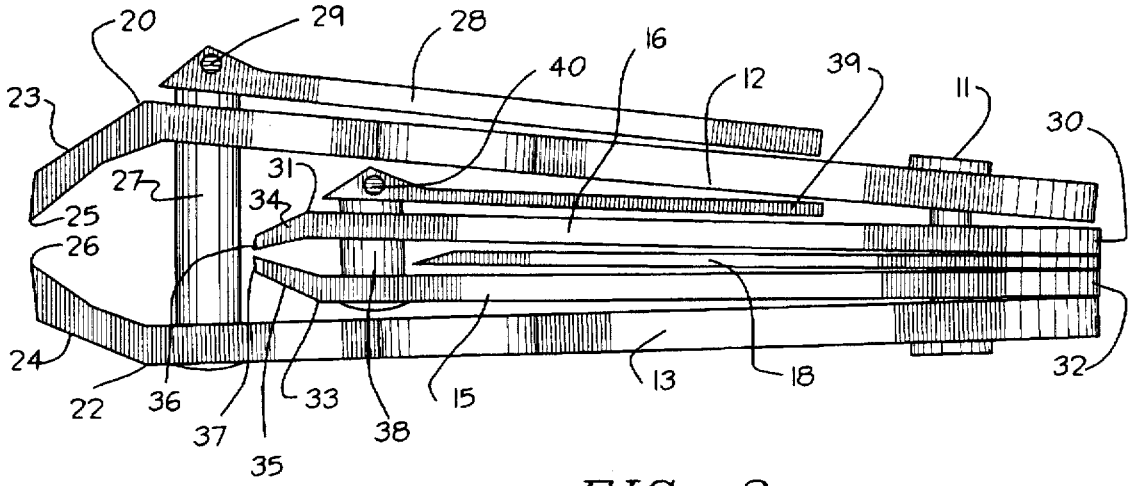
FIG. 3 is a side view of the invention, taken in elevation, indicating the first and second cutter assemblies in a nested configuration relative to one another.

The cuticle trimmer 10 of the invention comprises a primary axle 11 typically formed of a spring-like rod member, with first and second cutter plates 12 and 13 provided biased apart in a canted relationship, such that projection of the first and second cutter plates towards one another is operative against the primary axle 11 that in a spring-back manner directs the first and second cutter plates 12 and 13 apart at their forward ends, to be described in more detail below. The first and second cutter plates 12 and 13 define the first cutter assembly 14, while third and fourth cutter plates 15 and 18 define the second cutter assembly 17 that is oriented and mounted to the primary axle 11 between the first and second cutter plates 12 and 13. A file plate 18 is oriented between the third and fourth cutter plates 15 and 18 pivotally mounted about the primary axle 11. The first cutter plate has first plate first and second ends 19 and 20, while the second plate is defined by second plate first and second ends 21 and 22, such that a first plate extension flange 23 integrally extends from the first plate second end 20 (see FIG. 3), while the second plate extension flange 24 extends from the second plate second end 22. The respective first and second extension flanges 23 and 24 are canted towards one another terminating in respective first and second concave cutter edges 25 and 28 oriented in a mirror image relationship relative to one another, such as indicated in the FIGS. 1–3 for example. A first cutter axle 27 extends through the first and second cutter plates adjacent to the first and second cutter plates' second ends 20 and 22, such that a first lever plate 28 pivotally mounted about a first lever plate axle 29 to the first cutter axle 27 permits the fulcruming of the first and second concave cutting edges 25 and 28 towards one another, in a manner per se known in the prior art.

The second cutter assembly 17 provided with the third and fourth cutter plates 15 and 16 is such that the third cutter plate 15 includes third plate first and second ends 30 and 31 and fourth plate first and second ends 32 and 33, with the primary axle 11 extending through the third and fourth cutter plates 15 and 18 adjacent to the third and fourth plate first ends 30 and 32. A third plate extension flange 34 and a fourth plate extension flange 35 are canted towards one another and are integrally secured extending from the respective third and fourth plate second ends 31 and 33, such that the third plate extension flange 34 terminates in a first convex cutter edge 36 and the fourth plate extension flange 35 terminating in a second convex cutter edge 37, such that first and second convex cutter edges 38 and 37 are arranged in a facing mirror image relationship relative to one another. A second cutter axle 38 extends through the third and fourth cutter plates 15 and 16 adjacent to the third and fourth cutter plate second ends 31 and 33, such that a second cutter lever plate 39 is pivotally mounted to the second cutter axle 38 about a second cutter lever plate axle 40, such that upon displacement (see FIG. 2 for example) of the second cutter assembly 17 from between the first and second cutter plates 12 and 13 permits access and use of the second cutter assembly 17 to permit the access of the convex cutting edges 36 and 37 towards a cuticle (not shown) to be cut. The file plate 18 may be, as illustrated, oriented between the third and fourth cutter plates or if so desired, positioned exteriorly of the third and fourth cutter plates between the first and second cutter plates 12 and 13. Further, the file plate 18 is optional and need not specifically be employed by the assembly, but is thusly oriented for ease of nesting of the structure relative to one another for use as desired.

It is understood that to employ the first cutter assembly and the second cutter assembly 14 and 17 respectively, they must be pivoted relative to one another to permit free displacement of the relative cutter plates of the respective cutter assemblies to be utilized. Similarly, the file 18 must be displaced from between the third and fourth cutter plates when utilizing the second cutter assembly 17.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A cuticle trimmer, comprising:

a first cutter assembly, with the first cutter assembly including a first cutter plate and a second cutter plate, the first cutter plate including a first plate first end spaced from a first plate second end, the second cutter plate having a second plate first end spaced from a second plate second end, with a primary axle directed through the first cutter plate and the second cutter plate adjacent the first cutter plate first end and the second cutter plate first end, the first cutter plate including a first plate extension flange extending from the first plate second end, and a second plate extension flange extending from the second plate second end, with the first plate extension flange and the second plate extension flange terminating in a respective first concave cutter edge and a second concave cutter edge arranged in a facing mirror image relationship, with a second cutter assembly mounted pivotally about the primary axle between the first cutter plate and the second cutter plate, wherein the second cutter assembly includes a third cutter plate and a fourth cutter plate, with the third cutter plate having a third cutter plate first end spaced from a third cutter plate second end, and a fourth cutter plate having a fourth cutter plate first end spaced from a fourth cutter plate second end with the primary axle directed through the third cutter plate and the fourth cutter plate adjacent to the third cutter plate first end and the fourth cutter plate first end, and a third plate extension flange extending integrally from the third cutter plate second end, and a fourth plate extension flange extending integrally from the fourth cutter plate second end, with the third plate extension flange and the fourth plate extension flange terminating in a respective first convex cutter edge and a second convex cutter edge arranged in a facing mirror image relationship relative to one other.

2. A cuticle trimmer as set forth in claim 1 with a file plate pivotally mounted about the primary axle, and the file plate pivotally mounted between the third cutter plate and the fourth cutter plate.

3. A cuticle trimmer as set forth in claim 2 wherein the first plate extension flange and the second plate extension flange are canted towards one another, and the third plate extension flange and the fourth plate extension flange are canted towards one another.

* * * * *